US010123121B2

(12) United States Patent
Steijner et al.

(10) Patent No.: US 10,123,121 B2
(45) Date of Patent: Nov. 6, 2018

(54) WATER PROOF SPEAKER DEVICE

(71) Applicant: Sony Corporation, Tokyo (JP)

(72) Inventors: Magnus Steijner, Loddekopinge (SE); Olof Simonsson, Dalby (SE); Stjepan Begic, Bunkeflostrand (SE); Martin Nyström, Horja (SE)

(73) Assignees: Sony Corporation, Tokyo (JP); Sony Mobile Communications Inc, Tokyo (JP)

( * ) Notice: Subject to any disclaimer, the term of this patent is extended or adjusted under 35 U.S.C. 154(b) by 161 days.

(21) Appl. No.: 14/593,267

(22) Filed: Jan. 9, 2015

(65) Prior Publication Data

US 2016/0205469 A1 Jul. 14, 2016

(51) Int. Cl.

| | |
|---|---|
| ***H04R 1/02*** | (2006.01) |
| ***H04R 7/18*** | (2006.01) |
| ***H04R 1/44*** | (2006.01) |

(52) U.S. Cl.

CPC ..... *H04R 7/18* (2013.01); *H04R 1/02* (2013.01); *H04R 1/44* (2013.01); *H04R 2499/11* (2013.01)

(58) Field of Classification Search

CPC ... H04R 7/00; H04R 7/02; H04R 7/04; H04R 7/18; H04R 7/15; H04R 31/003; H04R 31/006; H04R 2307/00; H04R 2307/201; H04R 2307/204; H04R 2307/207; H04R 2207/00

See application file for complete search history.

(56) References Cited

U.S. PATENT DOCUMENTS

| | | | | |
|---|---|---|---|---|
| 5,209,226 | A | 5/1993 | Goodley | |
| 7,548,766 | B2 * | 6/2009 | Takahata | H04R 1/02 181/172 |
| 8,094,865 | B2 * | 1/2012 | Espiritu | H04R 7/20 381/398 |
| 2003/0123892 | A1 | 7/2003 | Ueki | |
| 2003/0202675 | A1 * | 10/2003 | Ito | H04R 7/18 381/398 |
| 2011/0317868 | A1 | 12/2011 | Tsujii | |
| 2012/0114160 | A1 * | 5/2012 | Lin | H04R 1/1091 381/380 |

FOREIGN PATENT DOCUMENTS

| | | | |
|---|---|---|---|
| EP | 1 998 591 | A2 | 12/2008 |
| WO | WO 2004/043113 | A1 | 5/2004 |
| WO | WO 2015/047410 | A1 | 9/2013 |

OTHER PUBLICATIONS

International Search Report, Application No. PCT/IB2015/054719, dated Sep. 15, 2015.

* cited by examiner

*Primary Examiner* — Duc Nguyen
*Assistant Examiner* — Taunya McCarty
(74) *Attorney, Agent, or Firm* — Tucker Ellis LLP

(57) ABSTRACT

The present disclosure relates to a speaker device and in particular to a speaker device having a water proof diaphragm, wherein the speaker device is designed to sustain a water pressure of 10 Atmospheres. The present disclosure further relates to an electronic device comprising the speaker device.

17 Claims, 3 Drawing Sheets

WATER PROOF SPEAKER DEVICE

TECHNICAL FIELD

The present disclosure relates to a speaker device and in particular to a speaker device having a water proof diaphragm, wherein the speaker device is designed to sustain a water pressure of 10 Atmospheres. The present disclosure further relates to an electronic device comprising the speaker device.

TECHNICAL BACKGROUND

The water resistance property of electronic devices is getting more and more important.

Historically, the Ingress Protection (IP) classification system has been used to describe water resistance for electronic devices.

FIG. 1 shows an example of a speaker device 10 according to prior art, which is designed to be water resistant, for example down to 1.5 meter under water, e.g. classified as IP×8 water resistant. In FIG. 1, a section of the speaker device 10 is shown. A diaphragm 16 of the speaker device is made of a water proof material and fastened to a housing of the speaker device 10. The housing comprises two parts, an upper part 12 and a lower part 14. At an opening 22 of the housing, a water permeable grill (not shown) is fastened. This means that water can enter the housing through the water permeable grill and put pressure on the diaphragm 16. But since the diaphragm is water proof, no water should be able to penetrate the diaphragm and come in contact with any water sensitive electronics below the diaphragm. An edge portion 20 of the diaphragm is fastened between the upper part 12 and the lower part 14 of the housing of the speaker device 10. A suspension 18, which is used as retaining means when the diaphragm 16 vibrates, typically has a convex design.

By the term "convex" should, in the context of present specification, be understood that the suspension curves outwards, towards the water permeable grill.

However, when the electronic devices may be worn at the wrist of a user, the IP classification is often not used, instead the Atmospheres (ATM) classification, which is the well established standard for water resistance among watches, is used.

Moreover, when the electronic device is wrist worn, the user is more likely to wear the electronic device when swimming, snorkelling and diving, thereby exposing the electronic device to a higher water pressure compared to regular portable electronic devices such as Smartphone's or Tablet computers.

The established classification of watches usually claims 5 ATM to be waterproof enough to use while swimming, and 10 ATM to be waterproof enough to use when snorkelling down to 10 meter water depth. 10 ATM means that depths down to 100 meters may be handled.

Consequently, it is advantageous if electronic devices, especially wrist worn accessories, are designed to sustain a water pressure of 10 Atmospheres. This puts very high demands on the entire construction of the electronic devices, but especially on acoustic components in the electronic devices.

SUMMARY OF THE INVENTION

According to a first aspect, example embodiments propose a speaker device that can sustain a water pressure of 10 Atmospheres.

According to example embodiments, a speaker device is provided. The speaker device comprises a housing having a water permeable grill, the housing comprising: a vibration generating unit, and a water proof diaphragm being configured to vibrate by vibration generated by the vibration generating unit, the diaphragm being a sheet structure having an upper and a lower surface, the diaphragm having a circumferential edge portion, a center portion and a suspension between the circumferential edge portion and the center portion, the edge portion being fastened to an inner side of the housing such that an open space is formed between the upper surface of the diaphragm and the water permeable grill. The lower surface of the edge portion of the diaphragm is fastened to the inner surface of the housing, and the upper surface of the edge portion of the diaphragm is facing the open space.

By fastening the diaphragm in such a way, a high water pressure is utilized for sealing the joint between the diaphragm and the housing of the speaker device. Consequently, water may not penetrate the joint when the speaker device is exposed to high water pressure.

According to a second aspect, example embodiments propose an electronic device comprising a speaker device according to the first aspect.

The electronic device may thus be water resistant up to 10 ATM.

Other objectives, features and advantages of the present invention will appear from the following detailed disclosure, from the attached dependent claims as well as from the drawings.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of the element, device, component, means, step, etc., unless explicitly stated otherwise.

BRIEF DESCRIPTION OF DRAWINGS

The above, as well as additional objects, features and advantages of the present invention, will be better understood through the following illustrative and non-limiting detailed description of embodiments of the present invention, with reference to the appended drawings, where the same reference numerals will be used for similar elements, wherein.

DETAILED DESCRIPTION OF EXAMPLE EMBODIMENTS

Figure 1:
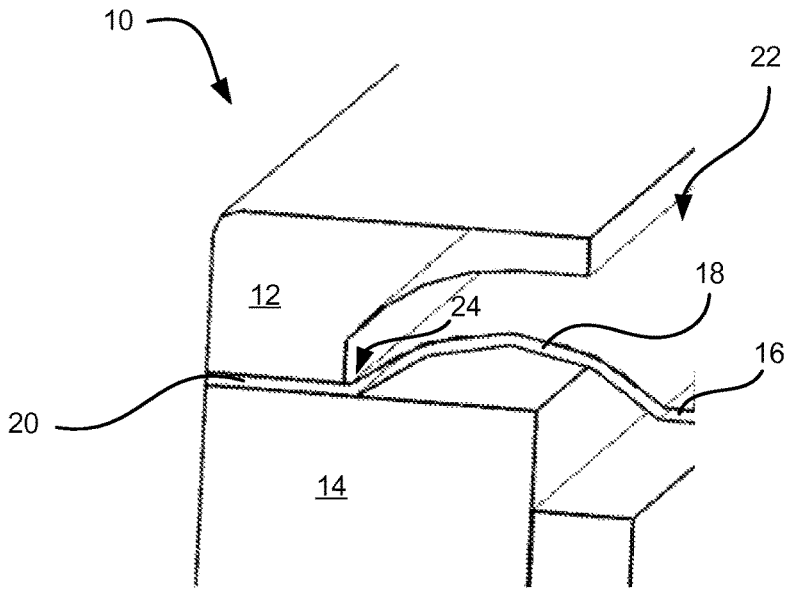
Fig. 1 (prior art)
FIG. 1 shows a prior art example of a water resistant speaker device.

As described above, FIG. 1 shows a speaker device 10 according to prior art, which is designed to resist water down to 1.5 meters depth. Beyond 1.5 meters, the water pressure may cause two failures to the speaker device:

The suspension 18 may collapse, i.e. the convex design may be put under such water pressure that it will be bent to "wrong" way. This in turn may mean that the diaphragm may not be able to vibrate as it should and thus wrongfully convert the intended mechanical motion (vibration) to sound.

A joint 24 between the housing and the diaphragm is exposed to the water pressure which may cause water to penetrate between the upper 12 and the lower 14 part of the housing. This means that the speaker device 10 may leak if put under too high water pressure which may damage surrounding electronics (not shown).

Figure 2:
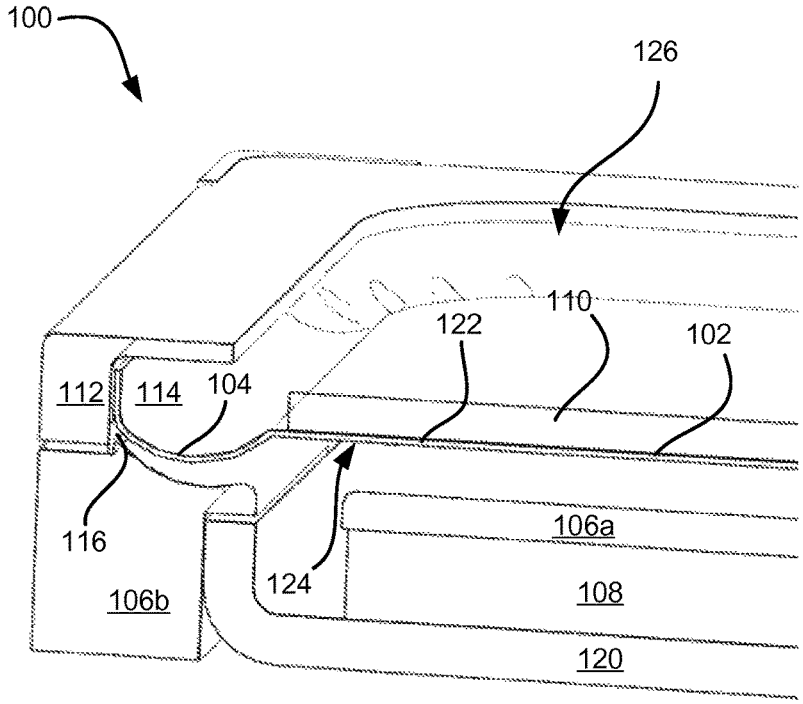
FIG. 2 shows by way of example a part of the speaker device according to embodiments, FIG. 3 schematically shows a design of a speaker device according to a first embodiment, FIG. 4 schematically shows a design of a speaker device according to a second embodiment, FIG. 5 schematically shows by way of example how the speaker device is fastened to an electronic device comprising the speaker device.

FIG. 2 shows by way of example a part of a speaker device 100 according to embodiments. The speaker device 100 comprises a housing 112, 106*b* which in this example embodiment consists of two parts, an upper part 112 and a lower part 106*b*. It should be noted that the housing may consist of one single part as well. The housing 112, 106*b* has an opening 126 which holds a water permeable grill (not shown) where sound waves generated by the speaker device can exit the speaker device. Since the grill is water permeable, water will penetrate through the grill when the speaker device is placed under water.

The housing 112, 106*b* comprises a vibration generating unit 108, 120, typically a voice coil. Further, the housing 112, 106*b* comprises a water proof diaphragm 102, 104, 114 being configured to vibrate by vibration generated by the vibration generating unit. The vibration generating unit may be of any suitable sort, e.g. the magnet may be made of ceramic, ferrite, Alnico etc. The feature of generating vibrations of the diaphragm 102, 104, 114 by a vibration generating unit 108, 120 is well known and left to the skilled person to implement.

The diaphragm 102, 104, 114 is a sheet structure having an upper 122 and a lower 124 surface. Since the diaphragm 102, 104, 114 needs to be water proof, suitable materials may be selected among water proof materials such as polyethylene, polythene or any type of suitable material. The diaphragm 102, 104, 114 comprises a circumferential edge portion 114, a center portion 102 and a suspension 104 between the circumferential edge portion 114 and the center portion 102. It should be noted that the different parts of the diaphragm may be made of different materials or the same material. For example, the suspension 104 and the edge portion 114 may be made of a rubber material while the center portion 102 is made from polythene. The edge portion 114 is fastened to an inner surface 116 of the housing 112, 106*b* such that an open space is formed between the upper surface 122 of the diaphragm 102, 104, 114 and the water permeable grill. When the speaker device 100 is placed under water, water will thus exert water pressure on the parts of the speaker device 100 that forms this open space.

In order to improve the water resistance of the speaker device 100, it is important to fasten the edge portion 114 of the diaphragm 102, 104, 114 onto the housing 112, 106*b* such that the water pressure is utilized for sealing the joint between the edge portion 114 and the housing 112, 106*b* of the speaker device 100. This is accomplished by fastening the lower surface 124 of the edge portion 114 of the diaphragm to the inner surface 116 of the housing 112, 106*b* in a way such that the upper surface 122 of the edge portion 114 of the diaphragm 102, 104, 114 is facing the open space. This means that the water pressure will push the edge portion 114 towards the housing 112, 106*b* and reduce the risk of leakage between the edge portion 114 and the inner surface 116 of the housing. Consequently, water may not penetrate the joint when the speaker device 100 is exposed to high water pressure.

The lower surface 124 of the edge portion 114 of the diaphragm 102, 104, 114 may be fastened to the inner surface 116 of the housing by at least one of: a glue, a tape, welding and forge welding.

According to the example embodiment shown in FIG. 2, the center portion 102 is flat, and the edge portion 114 is fastened substantially perpendicular to the flat center portion 102, This may facilitate a small speaker device 100 since the fastening utilizes already existing inner surface areas 116 of the housing 112, 106*b*.

As shown in FIG. Ulna, the suspension 104 is concave in a relaxed state.

By the term "concave" should, in the context of present specification, be understood that the suspension curves inwards, away from the water permeable grill.

This means that a high water pressure will not deform the suspension 104 since the suspension 104 is shaped such that the forces from the water pressure will be absorbed by the suspension 104.

The central portion 102 may optionally comprise a reinforcing structure 110. The reinforcing structure 110 may be an integral part of the central portion 102, or it may be a separate part fastened to the upper surface of the central portion. Using a separate part may simplify the manufacturing of the diaphragm 102, while using an integral part may simplify the process of assembling the speaker device 100.

The reinforcing structure 110 may stabilize the often very thin diaphragm 102, 104, 114, and may also make sure that the entire central portion 102 may be pushed down by the water pressure to the same extent.

As shown in FIG. 2, the speaker device 100 may comprise parts 106*a*, 1.06*b* that are designed to resemble the shape of the diaphragm, in particular the suspension 104 and the center portion 102. The function of these parts 106*a*, 106*b* will now be explained in conjunction with FIG. 3.

Figure 3:
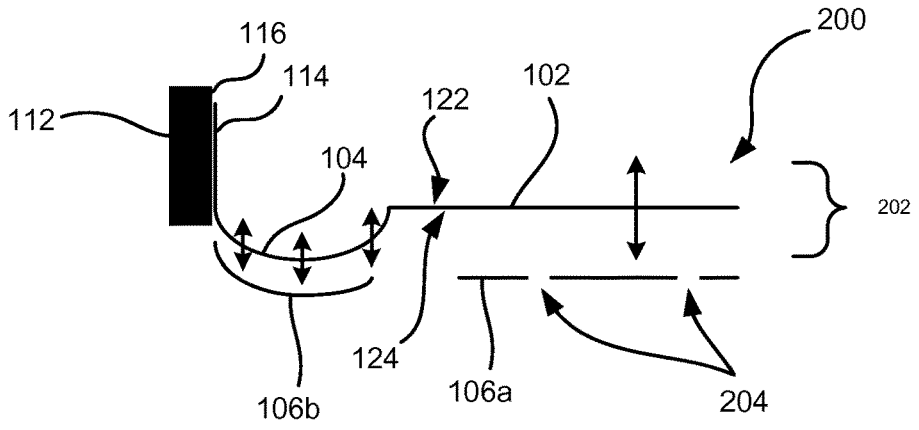

FIG. 3 is schematically describing a speaker device 200 according to embodiments. In FIG. 3, the edge portion 114 of the diaphragm 102, 104, 114 is fastened to the inner surface 116 of the upper part 112 of the housing as described in FIG. 2.

Moreover, the parts 106*a*, 106*b* described above function as a supporting structure for the suspension 104 and the center portion 102 and are placed on a lower surface side 124 of the suspension 104 and the center portion 102. When the speaker device is producing sound waves, the suspension 104 and the center portion 102 will vibrate within a vibration range 202. The vibration range 202 is determined by the vibration generating unit (not shown) as described in conjunction with FIG. 2. As seen by the bi-directional arrows in FIG. 3, different parts of the diaphragm 102, 104, 114, e.g. the suspension 104 and the center portion 102 may vibrate to different extent, mostly depending on the design of the suspension 104. According to some embodiments, the vibration range 202 may range between 0.5-1.5 mm, for a speaker device with the size of 6-8×12-16×2-3 mm (width×length×height).

The entire center part 102 may be designed to vibrate to the same extent, which may be further facilitated by the reinforcing structure 110 shown in FIG. 2. The diaphragm 102, 104, 114 is thus designed to handle vibrations within the vibration range 202 without being deformed. However, when the speaker device 200 is placed under water, the water pressure may push the suspension 104 and the center portion 102 of the diaphragm 102, 104, 114 outside the vibration range 202. This may cause deformation and malfunctioning of the diaphragm 102, 104, 114. By utilizing the parts 106*a*, 106*b* as a supporting structure for the suspension 104 and/or the center part 102 such that the supporting structures 106*a*, 106*b* will support the diaphragm if the diaphragm is pushed outside the vibration range, such deformation and malfunctioning may be avoided. In other words, whenever there is water pressure on the diaphragm 102, 104, 114, the center portion 102 and suspension 104 will be forced downwards. At a certain quantity of water pressure, the center portion 102 and suspension 104 will reach the respective supporting structures 106*a*, 106*b*, which will prevent any additional stress forces on the center portion 102 and suspension 104.

For the suspension 104, this is e.g, achieved by providing the housing with a concave portion on a lower surface side 124 of the suspension 104 such that the supporting structure 106*b* will support the suspension 104 if the diaphragm 102, 104, 114 is pushed outside the vibration range 202.

As described in FIG. 3, the supporting structure 106*a* and/or the supporting structure 106*b* may comprise at least one through hole 204 to allow for acoustic tuning of the speaker device 200. This means that the supporting structures 106*a*, 106*b* may not be configured to support the entire suspension 104 and/or the center part 102, and that the supporting structures 106*a*, 106*b* may not be entirely continuously shaped. On the contrary, the supporting structures 106*a*, 106*b* may only extend beneath a subpart of the parts of the diaphragm they are supposed to support. According to some embodiments, the supporting structure 106*a* is configured to support the center portion 102 to a coverage ratio and area distribution such that the center portion will remain flat if the center portion is pushed outside the vibration range. Using the reinforcing structure 110 shown in FIG. 2 may further reduce the required coverage ratio and area distribution of the supporting structure 106*a* beneath the center portion 102. Moreover, rigidity properties of the center portion 102 of the diaphragm 102, 104, 114 may also influence the required coverage ratio and area distribution of the supporting structure 106*a*.

It should be noted that according to some embodiments, only one or none of the supporting structures 106*a*, 106*b* are part of the speaker device 200.

Figure 4:
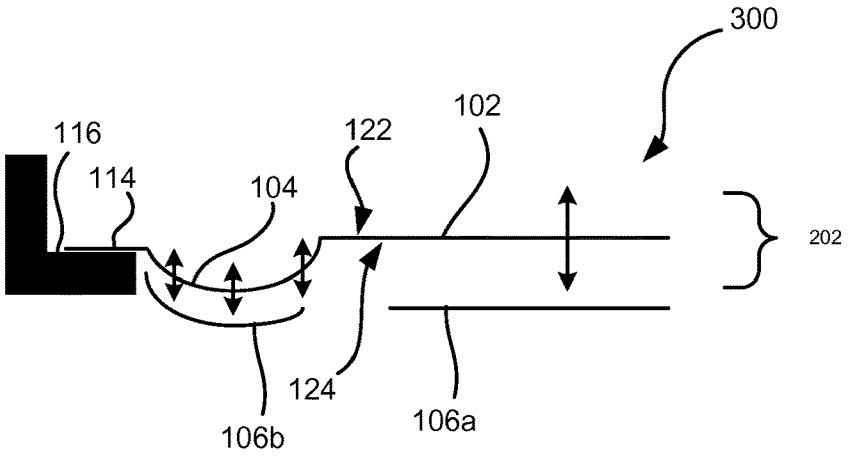

In FIGS. 2 and 3, the edge portion 114 of the diaphragm 102, 104, 114 is fastened substantially perpendicular to the flat center portion 102 onto the inner surface 116 of the housing 112. This is just one example of how the water pressure is utilized for sealing the joint between the edge portion 114 and the housing 112 of the speaker device. FIG. 4 describe such a sealing according to a second embodiment.

FIG. 4, the edge portion 114 is fastened substantially parallel to the flat center portion 102 but still in a way such that the lower surface 124 of the edge portion 114 of the diaphragm 102, 104, 114 is fastened to the inner surface 116 of the housing, and such that the upper surface 122 of the edge portion 114 of the diaphragm 102, 104, 114 is facing the open space as described in conjunction with FIG. 2.

Figure 5:
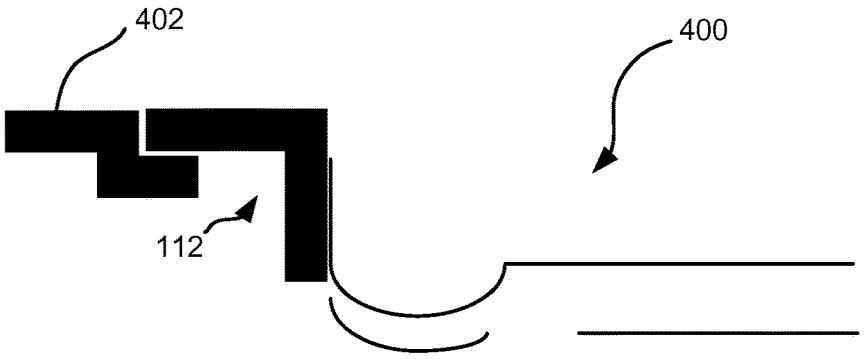

FIG. 5 shows by way of example how a speaker device 400 is fastened to an electronic device comprising the speaker device 400. The idea of utilizing water pressure for sealing a joint under water is not limited to the fastening of a diaphragm to a housing of a speaker device. In FIG. 4, the same idea is used to seal the joint between the speaker device 400 and the electronic device 402 to which the speaker device 400 is fastened. By designing the parts where the speaker device 400 is fastened to the electronic device 402 such that a lower surface of a edge portion of the speaker device 400 is fastened to a surface of the electronic device and such that the upper surface of the edge portion of the speaker device will be subjected to water pressure when being under water, the joint between the speaker device 400 and the electronic device 402 may withstand high water pressure.

Figure 6:
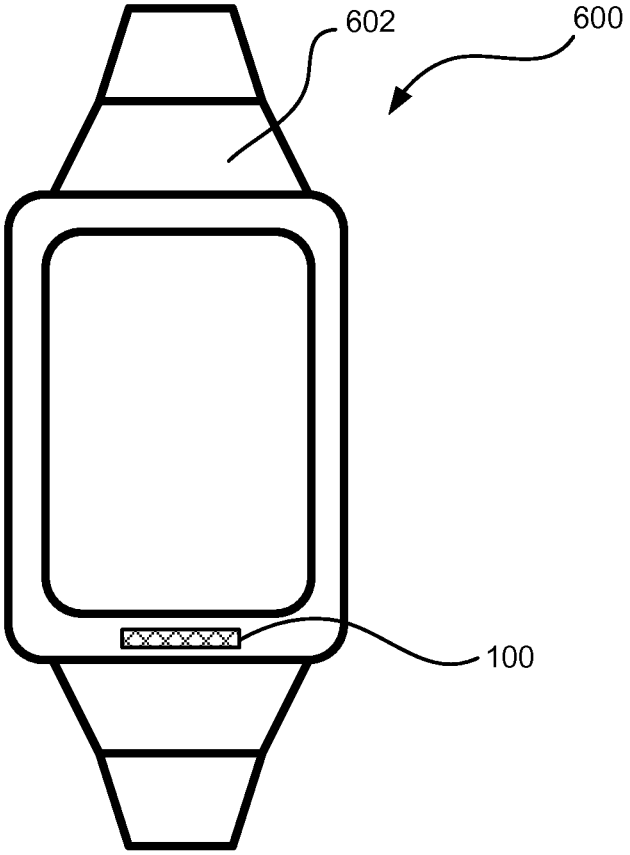
FIG. 6 shows by way of example an electronic device comprising the speaker device of any one of FIG. 1-4.

FIG. 6 shows by way of example an electronic device 600 comprising the speaker device 100 described in FIG. 2. However, the electronic device 600 may comprise a speaker device according to any of the embodiments described above. The speaker device 100 may be fastened according to the embodiment described in conjunction with FIG. 5. The electronic device 600 comprises a bracelet 602 capable of being attached to a wrist of a user. The electronic device may for example be a Smartwatch. As described above, it is more likely that a person is bringing the electronic device 600 when swimming and/or diving if the electronic device is worn on the wrist compared to if it is usually carried around in a pocket. However, it should be noted that the speaker device described herein may be incorporated in any electronic device, such as a mobile phone, headset, headphones, camera, tablet computer, toy etc.

It should be noted that the position of the speaker 100 on the electronic device 600 shown in FIG. 6 is just by way of example. The speaker device 100 may be located in any other suitable position on the electronic device. The size of the speaker device 100 may be ~0.8-1.5 $cm^2$ as described above.

By designing the speaker device 100 as described above, the electronic device may have a water resistance rating of 10 Atmospheres, ATM.

The person skilled in the art realizes that the present invention by no means is limited to the order of the steps in the exemplary embodiment of the method described above. On the contrary, variations are possible within the scope of the appended claims. For example, an ordinary shaped suspension, as shown in FIG. 1, may be employed in the speaker device as described in this disclosure.

The invention claimed is:

1. A speaker device comprising:

a housing;

a water proof diaphragm comprising a sheet structure having an upper and a lower surface, the upper surface being configured to be exposed to water, the water proof diaphragm comprising a circumferential edge portion, a center portion, and a suspension between the circumferential edge portion and the center portion; and a vibration generating unit configured to make the suspension and center portion vibrate within a vibration range, wherein the housing comprises a first supporting structure on a lower surface side of the center portion outside the vibration range such that the first supporting structure will support the center portion if the center portion is pushed outside the vibration rang, wherein the housing comprises a second supporting structure on a lower surface side of the suspension outside the vibration range such that the second supporting structure will support the suspension if the suspension is pushed outside the vibration range, and wherein the first supporting structure comprises at least one through hole to allow for acoustic tuning of the speaker device.

2. The speaker device of claim 1, wherein the first supporting structure is configured to support the center portion of the water proof diaphragm to a coverage ratio and area distribution such that the center portion will remain flat if the center portion is pushed outside the vibration range.

3. The speaker device of claim 1, wherein the suspension is concave in a relaxed state.

4. The speaker device of claim 1, wherein the center portion comprises a reinforcing structure.

5. The speaker device of claim 4, wherein the reinforcing structure is a separate part fastened to the upper surface of the diaphragm at the center portion.

6. An electronic device comprising the speaker device of claim 1.

7. The electronic device of claim 6, comprising a bracelet that is configured to be attached to a wrist of a user.

8. The electronic device of claim 6, having a water resistance rating of 10 Atmospheres, ATM.

9. The speaker device of claim 1, wherein upper and lower surfaces of the center portion are substantially flat and are parallel to each other.

10. The speaker device of claim 1, wherein the water proof diaphragm comprises a substantially uniform thickness throughout the circumferential edge portion and the center portion.

11. The speaker device according to claim 1, wherein the circumferential edge portion is bent with respect to the center portion and comprises an adhered surface that is substantially perpendicular to the center portion and fastened to an inner surface of the housing, the adhered surface comprising part of the lower surface of the water proof diaphragm.

12. The speaker device according to claim 11, wherein the circumferential edge portion further comprises an exposed surface that is parallel to the adhered surface and adjacent an open space above the upper surface of the water proof diaphragm.

13. The speaker device according to claim 12, wherein the adhered surface and the exposed surface of the circumferential edge portion that are parallel to each other are substantially flat.

14. The speaker device according to claim 11, wherein the inner surface of the housing is substantially perpendicular to the center portion of the water proof diaphragm.

15. The speaker device according to claim 14, wherein the circumferential edge portion of the water proof diaphragm does not extend beyond the inner surface of the housing.

16. The speaker device of claim 11, wherein the adhered surface of the circumferential edge portion of the water proof diaphragm is fastened to the inner surface of the housing by at least one of: a glue, a tape, welding and/or forge welding.

17. The speaker device of claim 12, wherein the exposed surface of the circumferential edge portion extends above the upper surface of the water proof diaphragm at the center portion upon the suspension being in a relaxed state.

* * * * *